US011244664B2

(12) United States Patent
Gaynier

(10) Patent No.: US 11,244,664 B2
(45) Date of Patent: Feb. 8, 2022

(54) KICK DRUM PEDAL

(71) Applicant: David Alan Gaynier, South Rockwood, MI (US)

(72) Inventor: David Alan Gaynier, South Rockwood, MI (US)

( * ) Notice: Subject to any disclaimer, the term of this patent is extended or adjusted under 35 U.S.C. 154(b) by 0 days.

(21) Appl. No.: 17/174,719

(22) Filed: Feb. 12, 2021

(65) Prior Publication Data

US 2021/0383778 A1 Dec. 9, 2021

Related U.S. Application Data

(60) Provisional application No. 63/103,266, filed on Jul. 27, 2020, provisional application No. 63/102,260, filed on Jun. 4, 2020.

(51) Int. Cl.
*G10D 13/11* (2020.01)

(52) U.S. Cl.
CPC ..... *G10D 13/11* (2020.02)

(58) Field of Classification Search
CPC ..... G10D 13/11; G10D 3/00
See application file for complete search history.

(56) References Cited

U.S. PATENT DOCUMENTS

| | | | | |
|---|---|---|---|---|
| 3,930,431 | A | 1/1976 | Magadini | |
| 4,048,896 | A | 9/1977 | Calato et al. | |
| 4,198,894 | A | 4/1980 | Della-Porta et al. | |
| 5,297,467 | A | 3/1994 | Hoshino | |
| 5,301,592 | A * | 4/1994 | Johnston | G10D 13/11 84/422.1 |
| 5,343,792 | A | 9/1994 | Liao | |
| 5,388,494 | A * | 2/1995 | Hoshino | G10D 13/11 84/422.1 |
| 5,714,701 | A | 2/1998 | Hsieh | |
| 6,222,108 | B1 | 4/2001 | Liao | |
| 6,399,866 | B2 | 6/2002 | Tanaka | |
| 7,197,957 | B2 | 4/2007 | Gatzen | |
| 7,449,626 | B2 | 11/2008 | Chen | |
| 7,579,539 | B2 | 8/2009 | Chen | |
| 7,579,540 | B2 | 8/2009 | Takegawa | |
| 7,633,000 | B2 | 12/2009 | Dorfman et al. | |
| 7,928,305 | B1 | 4/2011 | Chen | |
| 7,956,268 | B1 | 6/2011 | Liao | |
| 7,999,165 | B2 | 8/2011 | Chen | |
| 8,686,265 | B2 | 4/2014 | Johnston | |
| 10,152,955 | B2 | 12/2018 | Sikra | |
| 2019/0272809 | A1 | 9/2019 | Lenz | |

FOREIGN PATENT DOCUMENTS

DE 102014106248 A1 11/2014

* cited by examiner

*Primary Examiner* — Kimberly R Lockett
(74) *Attorney, Agent, or Firm* — Brooks Kushman P.C.

(57) ABSTRACT

A kick drum pedal assembly includes a footboard, a beater, and a travel limiter. The beater is connected to the footboard and is configured to rotate in response to depressing the footboard. The travel limiter is configured to limit rotation of the beater. The travel limiter has an arm connected to the drum beater and a stop connected to the footboard. The arm and drum beater are confined to rotate in unison. The arm is configured to engage the stop to limit rotation of the beater to a desired forward position in response depressing the footboard.

19 Claims, 6 Drawing Sheets

KICK DRUM PEDAL

CROSS-REFERENCE TO RELATED APPLICATIONS

This application claims the benefit of U.S. provisional application No. 63/102,260 filed on Jun. 4, 2020, and U.S. provisional application No. 63/103,266 filed on Jul. 27, 2020, the disclosures of which are hereby incorporated in their entirety by reference herein.

TECHNICAL FIELD

The present disclosure relates to kick pedals for percussion instruments such as drums.

BACKGROUND

Kick pedals for drums are configured to advance a beater to strike a drum skin in response to depressing a footboard of the kick pedal.

SUMMARY

A kick drum pedal assembly includes a base member, a footboard, an upright member, a drum beater and a travel limiter. The footboard is rotatably secured to the base member. The upright member is secured to and extends upward from the base member. The drum beater is rotatably secured to an opposing end of the upright member relative to the base member. The drum beater is connected to the footboard such that depression of the footboard rotates the drum beater in a first direction about the upright member and such that releasing the footboard rotates the drum beater in a second direction about the upright member that is opposite to the first direction. The travel limiter is configured to limit rotation of the drum beater in the first direction. The travel limiter includes guide rod, a stop, and a leverage arm. The guide rod has first and second ends. The guide rod is rotatably secured to the footboard at the first end. The stop is secured to the guide rod proximate to the second end. The leverage arm is connected to the drum beater such that the leverage arm and drum beater are confined to rotate in unison about the upright member in response to depressing or releasing the footboard. The leverage arm has a follower that is configured to engage and travel along the guide rod in response to rotation of the leverage arm. The leverage arm is configured to engage the stop to limit rotation of the drum beater to a desired forward position in the first direction.

A kick drum pedal assembly includes a footboard, a drum beater, a guide rail, a stop, and a leverage arm. The drum beater is connected to the footboard. The drum beater is configured to rotate in a first direction in response to depressing the footboard. The drum beater is configured to rotate in a second direction in response to releasing the footboard. The guide rail has first and second ends. The first end is secured to the footboard. The stop is secured to the guide rail proximate to the second end. The leverage arm is connected to the drum beater such that the leverage arm and drum beater are confined to rotate in unison. The leverage arm has a follower configured to engage and travel along the guide rail in response to rotation of the leverage arm. The leverage arm is configured to engage the stop to limit rotation of the drum beater to a desired forward position in the first direction.

A kick drum pedal assembly includes a footboard, a beater, and a travel limiter. The beater is connected to the footboard and is configured to rotate in response to depressing the footboard. The travel limiter is configured to limit rotation of the beater. The travel limiter has an arm connected to the drum beater and a stop connected to the footboard. The arm and drum beater are confined to rotate in unison. The arm is configured to engage the stop to limit rotation of the beater to a desired forward position in response depressing the footboard.

DETAILED DESCRIPTION

Figure 1:
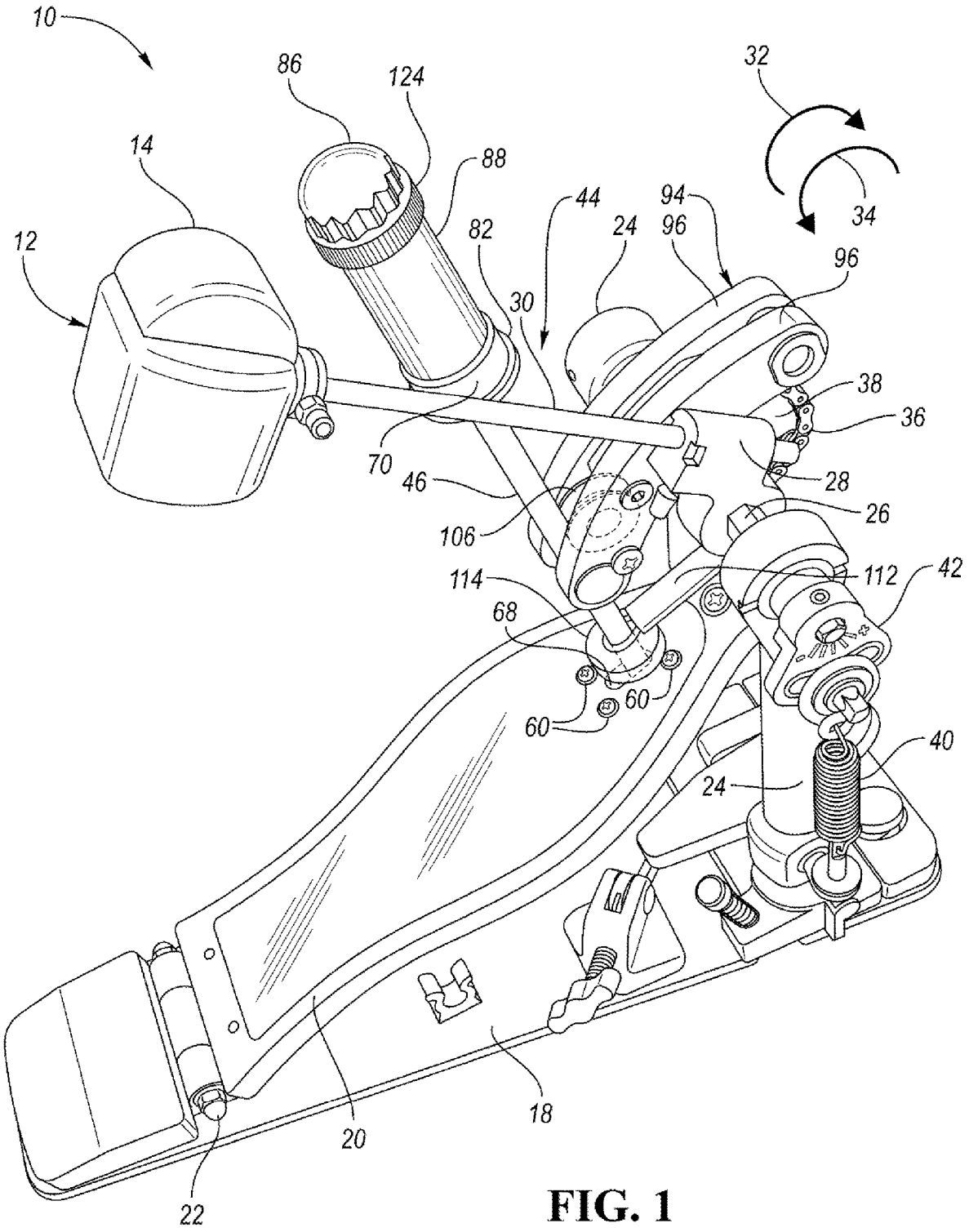
FIG. 1 is a perspective first side view of a of kick drum pedal assembly having a drum beater with the drum beater in a retracted or rearward position.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The kick drum pedal 10 described herein has the ability to give the drummer increased rebound speed and added rebound sensation. The kick drum pedal 10 mechanically controls the stop and rebound of the drum beater 12. The kick drum pedal 10 affects the sound of the drumskin or drumhead by controlling the impact and the consistency of force received by the drumhead. The action of the kick drum pedal 10 acts as a mechanical compression of the force on the drum beater 12. Sound compression is a tool utilized in audio sound engineering that enhances sound via electronic studio equipment, which is not mechanically related to the sound generation of an instrument, such as a drum. With the kick drum pedal 10 described herein, sound compression can be obtained mechanically.

High speed kick drum players need high tension drumheads to achieve rebound Control. Drummers using the kick drum pedal 10 described herein will be able to lower the drumhead tension, thus lowering the tone of the drum, while still maintain playing speed. The timing of the drum beater 12 of the kick drum pedal 10 may be adjusted by adjusting the axial position of a guide rod 46 of a travel limiting device 44 via jam nut 114, described in further detail below. Threading the guide rod 46 in or out sets the timing of beater contact point with the drumhead. The contact of the beater 12 to the drumhead is ideally set to simultaneously occur along with the initial contact between a leverage arm 94 and a spring-loaded stop 70 of the travel limiting device 44 (initial contact being where no additional compression force is added to the biasing element 88 acting on the stop 70 via the leverage arm 94), which is also described in further detail below. Adjusting a preload compression of a biasing element 88 acting on the stop 70 adjusts the distance the beater 12 travels beyond the contact point with the drumhead. The lighter the spring compression the deeper the penetration of the beater 12 into the drumhead.

With a traditional kick drum pedal, the drumhead acts to limit the travel of the drum beater and acts as bounce back mechanism to return of the beater to a position where the beater is no longer engaged with the drumhead. The drumhead is responsible for quick deceleration of the beater, and thus changing the inertia of the beater. The materials used to make drumheads and the tension applied to materials of drumheads have a major effect on the resistance and bounce back speed of the drum beater. The kick drum pedal 10 described herein can create the same effect with or without the drumhead.

The beater 12 can be set to make contact, before, at or after the drumhead by adjusting the axial position of the guide rod 46. The kick drum pedal 10 has more of an instantaneous lift action response. Kick drum pedal responsiveness provides feedback and increases the operator (i.e., drummer) control. Drummers have always pushed the limits of their physical abilities, which is paired with the mechanical response of the kick drum pedal being utilized. The travel limiting device 44 described herein allows drummers to satisfy their kick pedal response needs. For example, playing with a detuned kick drum with low tensioned drumhead will have poor bounce back effect with a traditional kick drum, which reduces the control of the kick drum pedal and the confidence of the drummer. The traveling limiting device 44 describe herein, however, will allow for a sufficient bounce back effect even if a drum has low tensioned drumhead. As another example, if a drummer has multiple kick drums with three different sizes (e.g., kick drums with diameters 18 inches, 24 inches, and 28 inches), each will be tuned to a different tension and each will have a different bounce back effect or feeling. The kick drum pedal 10 described herein with the traveling limiting device 44 will help the drummer dial in a uniform bounce back effect or feel regardless of the size of the drum. The goal is to change the drum size and not the feel of play. In order to get sufficient bounce back for a traditional kick drum pedal from low tensioned drumhead, the previous remedy was to tighten or loosen a return spring, which never really corrected the problem and could create more problems. For example, if the return spring was over tightened the kick drum pedal would feel hard and unbalanced resulting in fatigue of the drummer's muscles.

The kick drum pedal 10 accomplishes sufficient feedback by adding a second longer leverage arm 94 that is connected to the same fulcrum point as the short leverage arm 42 that is connected to the return spring 40. The leverage arm 94 is ideally set to make an initial contact with the stop 70 (i.e., initial contact where no additional compression force is added to biasing element 88 via the leverage arm 94) at the same time that the beater 12 makes contact with the drumhead. The biasing element 88 simulates the springiness or bounce back effect of the drumhead as the leverage arm 94 further compressing the biasing element 88 via the stop 70. The short leverage arm 42 maintains the tension on the return spring 40 to retract the beater 12 to a home or retracted position so that it is ready to strike the drumhead again.

The travel limiting device 44 may act as a mechanical compressor, creating uniformity of dynamic range from the drum. The travel limiting device 44 has the ability to stop the beater 12 before the beater's inertia over stretches the drumhead. Over stretching the drumhead will result in undesirable overtones. An overtone is simply the extra harmonics heard above and beyond the fundamental note that is produced with the attack (i.e., when the beater first hits the drumhead). The overtones are the resulting harmonics heard after the beater first strikes the drumhead.

The kick drum pedal 10 is also capable of being converted to a practice pedal with or without being removed from a drum set. For example, the travel limiting device 44 may be set such that the kick drum pedal 10 will not strike the drumhead, effectively transitioning the kick drum pedal 10 into a practice pedal. The travel limiting device 44 directly stops foot momentum and directly lifts the footboard 20 simulating the presence of a drumhead. The kick drum pedal 10 can create or enhance kick drum skin rebound response. The kick drum pedal 10 improves the quality of drum sound by limiting the beater 12 from over traveling. Over traveling stretches the drumhead causing excessive stress energy dissipating into overtones. The kick drum pedal 10 shortens beater recovery time, increasing the speed of each striking cycle.

Figure 2:
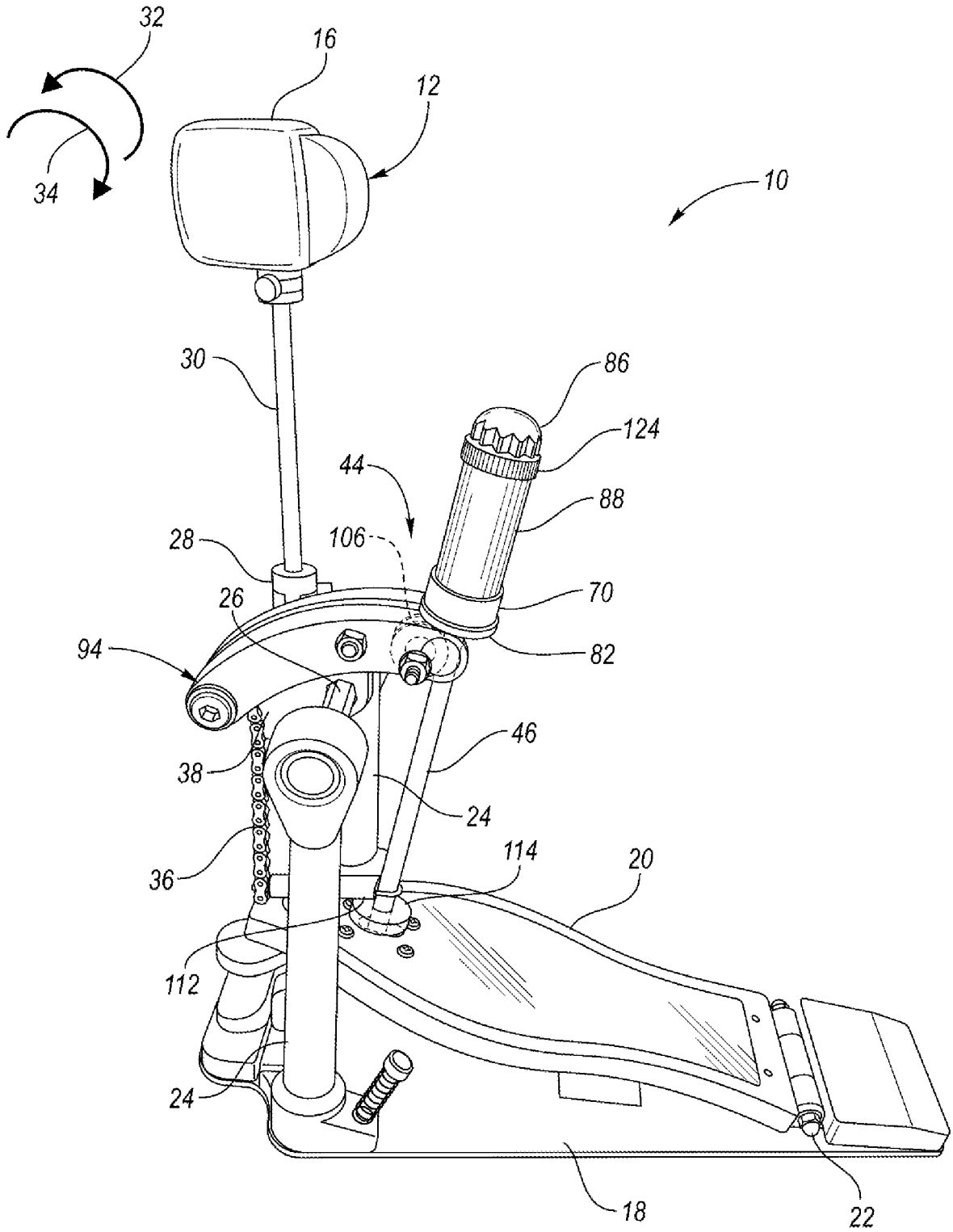
FIG. 2 is a perspective second side view of the kick drum pedal assembly with the drum beater in an advanced or forward position.

Referring to FIGS. 1 and 2, perspective sides views of the kick drum pedal assembly 10 having a drum beater 12 are illustrated. In FIG. 1, the drum beater 12 is in a retracted or rearward position 14. In FIG. 2, the drum beater 12 is in an advanced or forward position 16. The kick drum pedal assembly 10 includes a base plate or base member 18. A footboard 20 is rotatably secured to the base member 18 by a pin 22. The kick drum pedal assembly 10 includes one or more upright members 24 secured to and extending upward from the base member 18. It is noted that in the embodiment depicted herein, there are two upright members 24. An axle or shaft 26 may be rotatably secured to each of the upright members 24. Bearings may be secured to the upright members 24 to support and facilitate rotation of the shaft 26. The drum beater 12 is secured to shaft 26 by a clamp 28 and rod 30 such that the drum beater 12 and shaft 26 are confined to rotate in unison. The shaft 26 and drum beater 12 are secured to opposing or opposite ends of the one or more upright members 24 relative to the base member 18. The shaft 26 may have a polygonal (e.g., hexagon) or other shape in a central portion of the shaft 26 that acts as a key that engages keyed orifices defined by components that are attached to the shaft 26 (e.g., clamp 28), so that components that are attached to the shaft 26 and the shaft 26 are confined to rotate in unison.

The drum beater 12 and shaft 26 are connected to the footboard 20 such that depression of the footboard 20 rotates the drum beater 12 and shaft 26 in a first direction 32 about the one or more upright members 24 toward the advanced or forward position 16, and such that releasing the footboard 20 rotates the drum beater 12 and shaft 26 about the one or more upright members 24 in a second direction 34 toward the retracted or rearward position 14. The second direction 34 may be opposite to the first direction 32. More specifically, the footboard 20 may be connected to the shaft 26 via a chain 36 and sprocket 38. The chain 36 may be anchored to the footboard 20 while the sprocket 38 is secured to the shaft 26 such that the sprocket 38, shaft 26, and the drum beater 12 are confined to rotate in unison. The chain 36 may engage the sprocket 38 upon depressing the footboard 20 to rotate the sprocket 38, shaft 26, and the drum beater 12 in the first direction 32.

It should be understood, however, that this disclosure should not be construed to a chain and sprocket mechanism that translates the motion of depressing the footboard 20 to rotation of the shaft 26 and drum beater 12. For example, a direct drive design may be utilized where a rod, linkage, member, etc. is utilized to translate the motion of depressing the footboard 20 to rotation of the shaft 26 and drum beater 12. Such a rod, linkage, member, etc. of a direct drive design may be rotatably connected to the footboard 20 at a first position or end and may be rotatably connected to the shaft 26 at a second position or end.

A return spring 40 may be configured to retract and rotate the drum beater 12 and shaft 26 in the second direction 34 upon releasing the footboard 20. The spring 40 is connected to the short leverage arm 42 which is connected to shaft 26. The position at which the spring 40 is anchored to the short leverage arm 42 may be adjustable to adjust the tension on the spring 40. The spring 40 may be any type of biasing element that biases the beater 12 and shaft 26 toward the retracted or rearward position 14 via shaft 26.

Figure 3:
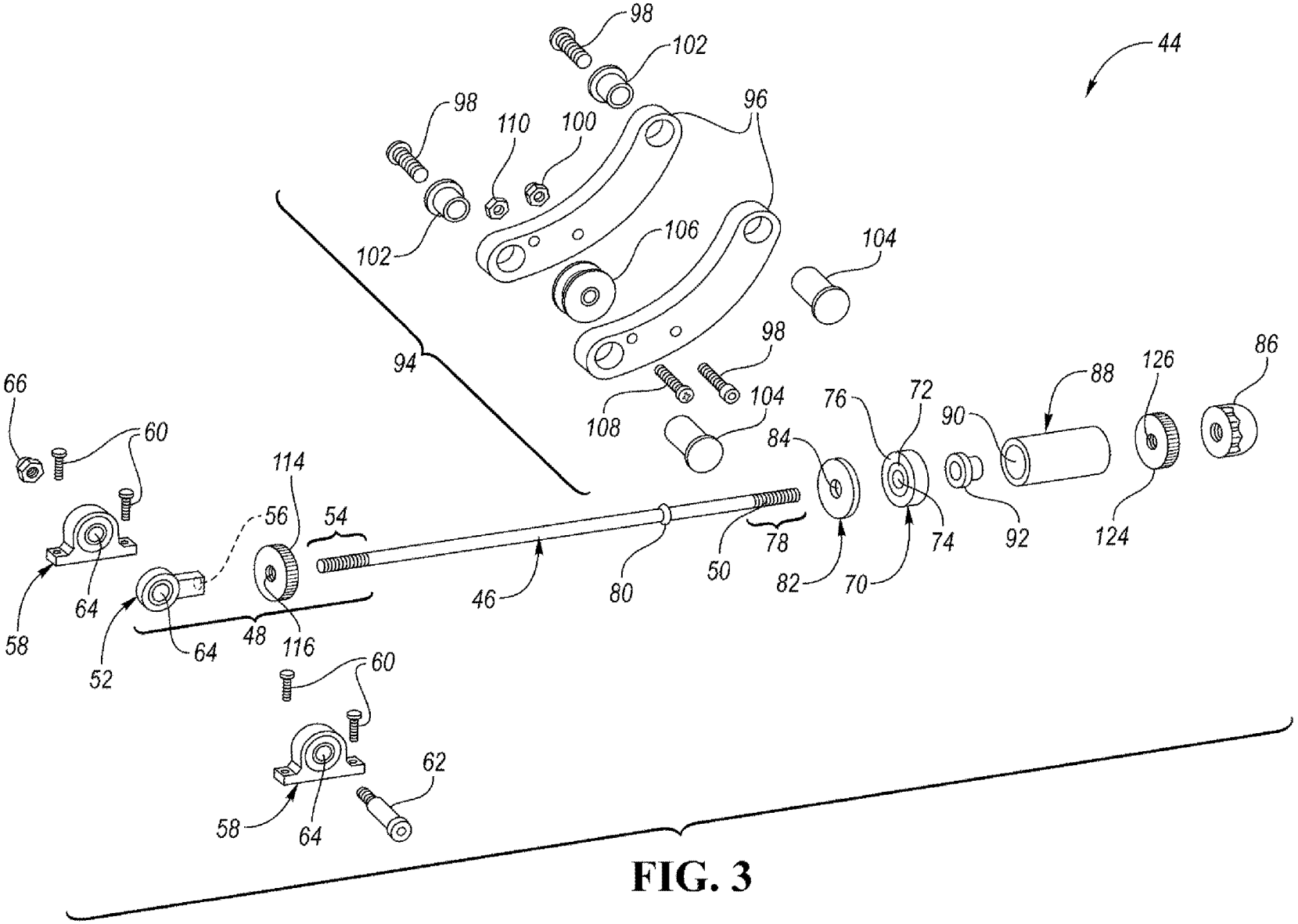
FIG. 3 is an exploded view of a travel limiting device or travel limiter for the drum beater.

Referring now to FIGS. 1-3, the kick drum pedal assembly 10 includes a travel limiting device or travel limiter 44 that is configured to limit rotation of the drum beater 12 and shaft 26 in the first direction 32. Please note that some of the components in FIG. 3 may not be in the proper orientation for illustrative purposes.

The travel limiter 44 includes a guide rail or guide rod 46 having first 48 end and a second end 50. The first end of 48 the guide rod 46 may be secured to the footboard 20. More specifically, the first end 48 of the guide rod 46 may be rotatably secured to the footboard 20. The first end 48 of the guide rod 46 may include a rod end piece 52 and a first threaded portion 54. The rod end piece may define a tapped hole 56 that engages the first threaded portion 54 to secure the rod end piece 52 to the main portion of the guide rod 46. Bearing blocks 58 may be secured to a bottom surface of the footboard 20 via fasteners 60. A shaft or axle 62 may extend through aligned holes 64 in the rod end piece 52 and bearing blocks 58. The guide rod 46 may pivot about axle 62. The shaft or axle 62 may more specifically be a shoulder bolt that is secured within the aligned holes 64 via a nut 66. The nut 66 may more specifically be a lock nut. The footboard 20 may define a slot 68. The guide rod 46 may extend upward through the slot 68. The guide rod 46 may pivot on axle 62 between the long ends of the slot 68.

The travel limiter 44 includes a stop 70 that may be secured to the second end 50 of the guide rod 46. The stop 70 may more specifically be adjacent to or proximate to the second end 50 of the guide rod 46. The stop 70 may be a combination of a bushing 72 that defines a center hole 74 and a circular plate or washer 76. The second end 50 of the guide rod 46 may define a second threaded portion 78. A sleeve 80 may be disposed on the guide rod 46 proximate the second end 50. The sleeve 80 may be press fit onto the guide rod 46 and may be spaced apart from the second threaded portion 78. The guide rod 46 may extend through the center hole 74 and the bushing 72 may engage the sleeve 80 such that the stop 70 is restricted from moving past the sleeve 80 in a direction toward the first end 48, and such that the stop 70 is positioned proximate the second end 50 of the guide rod 46. A felt washer 82 may be disposed between the stop 70 and the sleeve 80. The felt washer 82 may be utilized to prevent direct contact between the stop 70 and other moving components, such as a leverage arm (discussed further below), in order to prevent scuffing or scratching the stop 70 and the other moving components. The felt washer 82 may also define a center hole 84 and the guide rod 46 may extend through the center hole 84. The sleeve 80 may also restrict the felt washer 82 from moving past the sleeve 80 in a direction toward the first end 48.

A cap 86 may be secured to the second end 50 of the guide rod 46. More specifically, the cap 86 may include a tapped hole that engages the second threaded portion 78 to secure the cap 86 to the second end 50 of the guide rod 46. A biasing element 88 may be disposed between the cap 86 and the stop 70. The biasing element 88 is also disposed between the stop 70 and the second end 50 of the guide rod 50. The biasing element 88 is configured to bias the stop 70 in a direction away from the second end 50 of the guide rod 46, toward the first end 48 of the guide rod 46, and into engagement with the sleeve 80 (please note the felt washer 82 may be between the stop 70 and the sleeve 80). The biasing element 88 may be any type of biasing element, such as a compression spring or a resilient plastic or rubber material. In the illustrated embodiment, the biasing element 88 is a rubber tube. The guide rod 46 extends through a central orifice 90 defined by the biasing element 88. A centering bushing 92 is disposed within the central orifice 90 between the guide rod 46 and the biasing element 88. The centering bushing 92 concentrically aligns the biasing element 88 with the guide rod 46.

The travel limiter 44 includes a leverage arm 94 that is connected to the drum beater 12 such that the leverage arm 94 and drum beater 12 are confined to rotate in unison. Alternatively, the leverage arm 94 may be connected to any one or combination of the sprocket 38, shaft 26, and the drum beater 12 such the leverage arm 94, sprocket 38, shaft 26, and the drum beater 12 are all confined to rotate in unison about the one or more upright members 24 in response to the depressing or releasing the footboard 20. In the illustrated embodiment, the leverage arm 94 includes a pair of arms 96 that function as a clamp that engages the chain 36 and sprocket 38 to secure the leverage arm 94 to the chain 36 and sprocket 38. Fasteners 98 may extend through orifices defined in each of the arms 96 to secure the arms 96 to each other and to form the clamp. The fasteners 98 may engage either nuts 100, which may be lock nuts. Alternatively, the fasteners 98 may extend through a first bushing 102 that defines a through hole and may engage a tapped hole defined by a second busing 104. Such bushings may be necessary if the arms are prefabricated an include oversized holes.

The leverage arm 94 is configured to engage the stop 70 to limit rotation of the drum beater 12 to a desired forward position (e.g., the advanced or forward position 16) in the first direction 32 in response depressing the footboard 20. The desired forward position may be set such that a desired amount of compression of the biasing element 88 occurs via the stop 70 resulting in the stop 70 moving away from the sleeve 80 and toward the second end 50 of the guide rod 46. The distance that the stop 70 moves away from the sleeve 80 will be equal to the amount of compression (i.e., the amount of reduction in the length) of the biasing element 88.

Stated in other terms, the leverage arm 94 is configured to advance the stop 70 from a first position to a second position in response to depressing the footboard 20. The first position corresponds to an initial engagement between the leverage arm 94 and the stop 70, and a zero compression of the biasing element 88 via the leverage arm 94. The second position corresponds to the desired forward position of the drum beater 12 in the first direction 32 and a desired compression of the biasing element 88 via the leverage arm 94.

The leverage arm 94 may include a follower 106. The follower 106 may more specifically be a low friction U-shape guide roller or spool. The follower 106 may be sandwiched between the arms 96. A fastener 108 may extend through orifices defined in the arms 96 and a central orifice defined by the follower 106. The fastener 108 may engage a nut 110, which may be a lock nut, to secure the follower 106 to the arms 96. The follower 106 may be configured to rotate about the fastener 108. The fastener 108 may more specifically be a shoulder bolt. The follower 106 is configured to engage and travel along the guide rod 46 in response to rotation of the leverage arm 94 resulting from depression of the footboard 20.

The kick pedal drum assembly 10 may also include a gag linkage 112 that is secured to the guide rod 46 and the chain 36 that connects the drum beater 12 to the footboard 20. The gag linkage 112 is configured to bias the guide rod 46 into engagement with the follower 106 to ensure that the leverage arm 94 will engage the stop 70. In the illustrated embodiment, the gag linkage 112 is a rigid element, such as a steel wire covered with a plastic sleeve. The rigid gag linkage 112 pulls on the chain 36, which provides a biasing force on the guide rod 46 to force the guide rod 46 into engagement with the follower 106. In an embodiment that includes a direct drive design, however, where a rigid rod, linkage, member, etc. is utilized to translate the motion of depressing the footboard 20 to rotation of the shaft 26 and drum beater 12, the gag linkage 112 itself may be a biasing element, such as a spring, which provides the biasing force on the guide rod 46 to force the guide rod 46 into engagement with the follower 106.

Referring now to FIGS. 1-4, an axial position of guide rod 46 relative to the footboard 20 may be adjustable at the first end 48 of the guide rod 46. Stated in other terms, the position of the second end 50 of the guide rod 46 and the stop 70 relative to the footboard 20 may be adjusted based on how far the first threaded portion 54 is threaded into the tapped hole 56. Once a desired axial position of the guide rod 46 is set, a jam nut 114 may be utilized the fix the desired axial position of the guide rod 46. The jam nut 114 may include tapped hole 116. The tapped hole 116 may engage the first threaded portion 54 such that the jam nut 114 is disposed on the guide rod 46. Once the desired axial position of the guide rod 46 is set, the jam nut 114 may be adjusted such that it is forced into contact with the rod end piece 52, which creates a compression force between the jam nut 114 and the rod end piece 52 and secures desired axial position of the guide rod 46. The jam nut 114 may more specifically be a thumb screw nut.

An adjustment to the axial position of guide rod 46 corresponds to an adjustment to a first forward position of the drum beater 12. The first forward position corresponds to the initial contact between the leverage arm 94 and the stop 70 (initial contact being where no additional compression force is added to the biasing element 88 acting on the stop 70 via the leverage arm 94). The initial contact between the leverage arm 94 and the stop 70 is also ideally set to coincide with the initial contact between the drum beater 12 and the drumhead (i.e., the first forward position of the drum beater is ideally set to be where the drum beater 12 initially contacts the drumhead).

Figure 4:
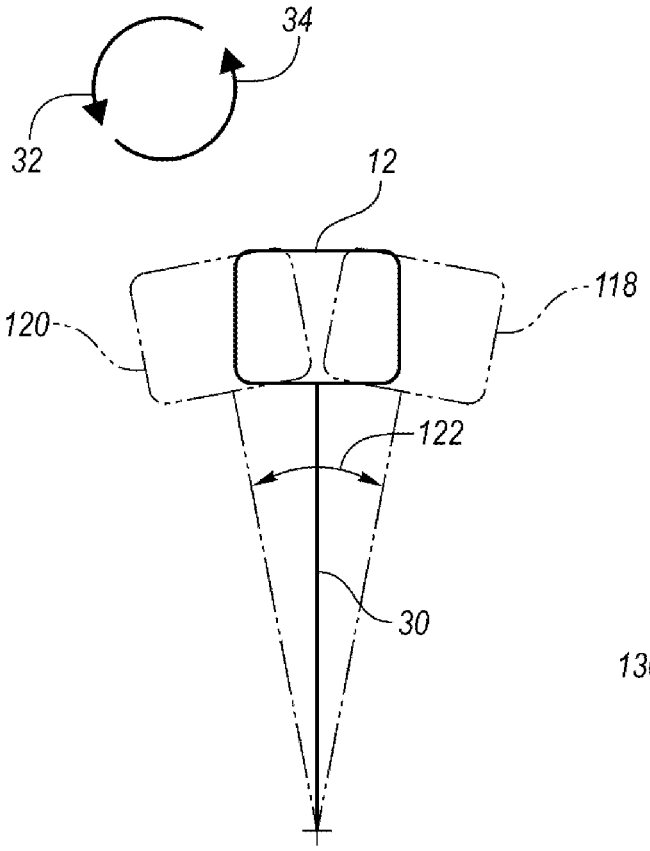
FIGS. 4 and 5 illustrate various adjustments positions to the advanced or forward position of the drum beater.

Further threading the first threaded portion 54 into the tapped hole 56 will lower the position of the stop 70 resulting in the leverage arm 94 contacting the stop 70 after traveling a shorter distance when the footboard 20 is depressed. This will cause the first forward position of the drum beater 12 to move rearward. Further threading the first threaded portion 54 out of the tapped hole 56 will raise the position of the stop 70 resulting in the leverage arm 94 contacting the stop 70 after traveling a further distance when the footboard 20 is depressed. This will cause the first forward position of the drum beater 12 to move forward. A most rearward first forward position 118 and a most forward first forward position 120 of the drum beater 12 that may result from adjusting the axial position of guide rod 46 are illustrated in FIG. 4. The range of adjustment of the first forward position of the drum beater 12 that may result from adjusting the axial position of guide rod 46 is illustrated as arrow 122 in FIG. 4.

Referring now to FIGS. 1-3 and 5, the travel limiter 44 further comprises a retainer plate 124 secured to the second end 50 of the guide rod 46. The biasing element 88 is disposed between the stop 70 and the retainer plate 124. The retainer plate 124 may include tapped hole 126. The retainer plate 124 may more specifically be a thumb screw nut. The tapped hole 126 may engage the second threaded portion 78 such that the retainer plate 124 is disposed on the guide rod 46 between the biasing element 88 and the cap 86. The position of the retainer plate 124 is adjustable relative to the stop 70 such that an adjustment of the retainer plate 124 adjusts a preload force on the biasing element 88. For example, the position of the retainer plate 124 may be adjusted to decrease the distance between the stop 70 and the retainer plate 124, which corresponds to increasing the preload force on the biasing element 88, or the position of the retainer plate 124 may be adjusted to increase the distance between the stop 70 and the retainer plate 124, which corresponds to decreasing the preload force on the biasing element 88.

An adjustment to the preload force on the biasing element 88 corresponds to an adjustment to a second forward position of the drum beater 12 and an adjustment to the second position of the stop 70 (i.e., the position of the stop 70 that corresponds to the desired forward position of the drum beater 12 in the first direction 32 and the desired compression of the biasing element 88 via the leverage arm 94). The second forward position of the drum beater 12 may also be the desired forward position of the drum beater 12. The difference between the first and second forward positions of the drum beater 12 may coincide with the beater 12 penetrating the drumhead (i.e., a distance where the drum beater 18 penetrates the drumhead beyond the initial contact or beyond the first forward position of the drum beater 12).

Figure 5:
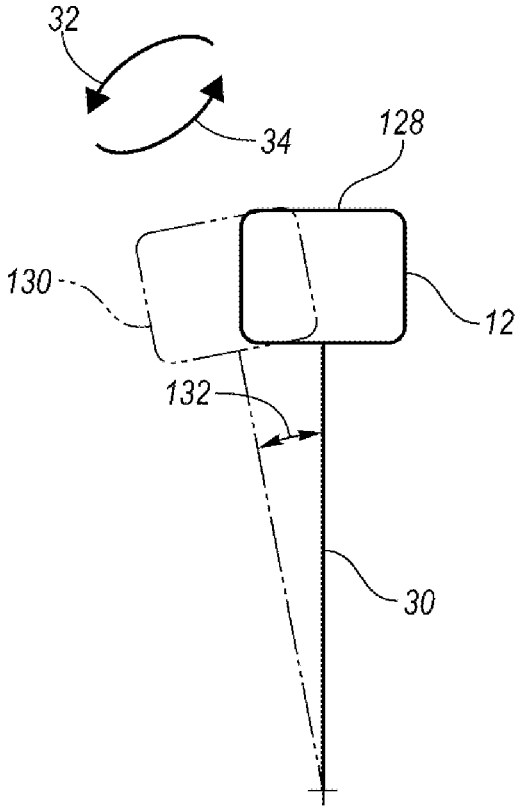

The position of the drum beater 12 when the stop 70 is at the first position (i.e., the position of the stop 70 that corresponds to an initial engagement between the leverage arm 94 and the stop 70 and a zero compression of the biasing element 88 via the leverage arm 94) may be illustrated as position 128 in FIG. 5, which coincides with the first forward position of the drum beater 12. The position of the drum beater 12 when the stop 70 is at the second position, the compression of the biasing element 88 via the leverage arm 94 is at the desired compression, and the drum beater 12 is at the desired (or second) forward position may be illustrated at position 130 in FIG. 5. The difference between the first and second forward positions of the drum beater 12 may be illustrated as arrow 132 in FIG. 5. It should also be noted that the biasing element 88 is further compressed via the leverage arm 94 as the drum beater 12 travels from position 128 to position 130 in FIG. 5

Position 130 may also represent a most forward second or desired position of the drum beater 12 that results from the lowest set preload force on the biasing element 88. Position 128 may also represent a most rearward second or desired position of the drum beater 12 that results from the highest preload force on the biasing element 88. More specifically, if the preload force of the biasing element 88 were to be set so high that the leverage arm 94 does not further compress the biasing element 88, the second or desired position of the drum beater would correspond to position 128 in FIG. 5. The range of adjustment of the second or desired position of the drum beater 12 that may result from adjusting preload force on the biasing element 88 may also be illustrated as arrow 132 in FIG. 5.

Figure 6A:
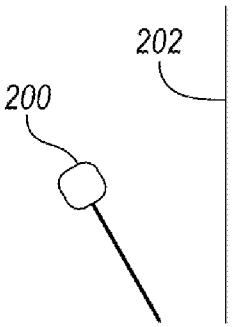
FIG. 6A-6I illustrate the striking sequence for a drum beater of a conventional kick pedal drum assembly.
Figure 6B:
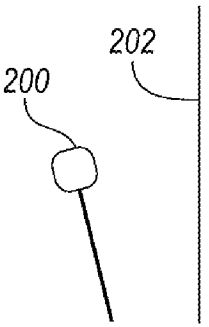

Referring to FIGS. 6A-6I, the striking sequence for a drum beater 200 relative to a drumhead 202 for a conventional kick pedal drum assembly is illustrated. It should be noted that the striking sequence advances in order from FIG. 6A to FIG. 6I. It should also be noted that the images in FIG. 6A-6I are for illustrative purposes only and may not represent the exact shape or exact relative positions of each component. In FIG. 6A, the drum beater 200 is at a home or retracted position relative to the drumhead 202. In FIG. 6B, the footboard of the conventional kick pedal drum assembly is depressed, and the drum beater 200 advances toward the drumhead 202.

Figure 6C:
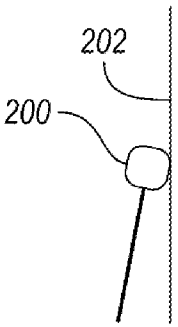
Figure 6D:
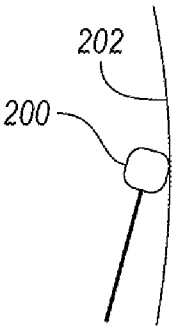

The drum beater 200 then makes an initial contact with the drumhead 202 in FIG. 6C creating a slap sound. The stress on the drumhead 202 is too small in FIG. 6C to overcome the inertia force of the drum beater 200. Next, the drum beater 200 further penetrates the drumhead 202 to creating the desired punch sound vibration in FIG. 6D. However, the stress on the drumhead 202 is still too small in FIG. 6D to overcome the inertia force of the drum beater 200, resulting in the drum beater 200 advancing further into and over stretching the drumhead 202 in FIG. 6E. Over stretching the drumhead 202 creates high tension on the drumhead 202 and undesirable overtones.

Figure 6E:
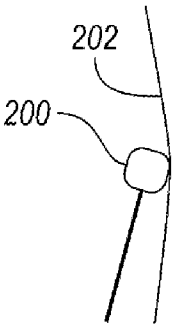
Figure 6F:
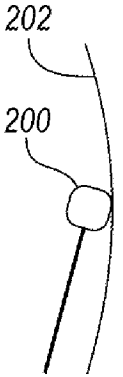
Figure 6G:
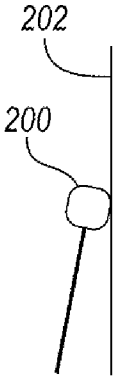
Figure 6H:
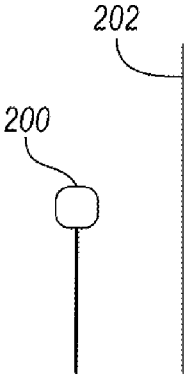
Figure 6I:
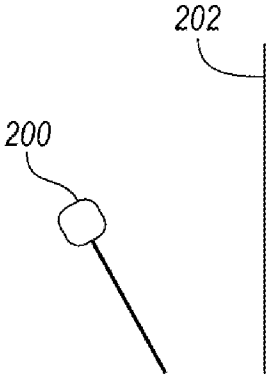

The stress on the drumhead 202 in FIG. 6E is finally large enough to overcome the inertia force of the drum beater 200 and the drumhead 202 begins to push the drum beater 200 away from the drumhead 202. In FIGS. 6F through 6I, the drum beater is further retracted via a return spring (e.g., return spring 40). The undesirable overtone sounds and/or ringing continues and may finally fade into an unnoticeable sound by the time the drum beater returns to the home or retracted position at FIG. 6I.

Figure 7A:
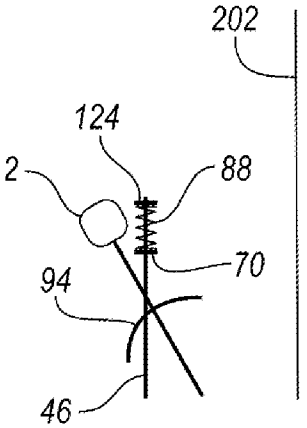
FIG. 7A-7H illustrate the striking sequence for a drum beater of a kick pedal drum assembly having the travel limiting device described herein.
Figure 7B:
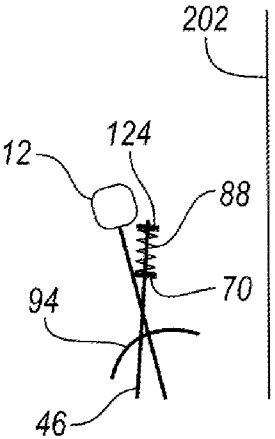

Referring to FIGS. 7A-7H, the striking sequence for the drum beater 12 relative to the drumhead 202 for the kick pedal drum assembly 10 described herein is illustrated. It should be noted that the striking sequence advances in order from FIG. 7A to FIG. 7H. It should also be noted that the images in FIG. 7A-7H are for illustrative purposes only and may not represent the exact shape or exact relative positions of each component. In FIG. 7A, the drum beater 12 is at the home or retracted position relative to the drumhead 202. In FIG. 7B, the footboard 20 of the kick pedal drum assembly 10 is depressed, and the drum beater 12 advances toward the drumhead 202.

Figure 7C:
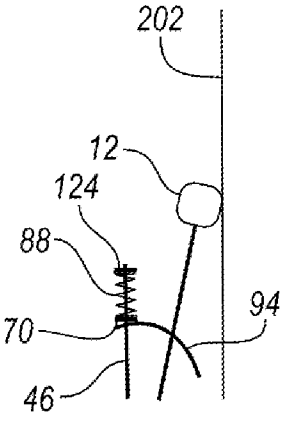

The drum beater 12 then makes an initial contact with the drumhead 202 in FIG. 7C creating a slap sound. The stress on the drumhead 202 is too small in FIG. 7C to overcome the inertia force of the drum beater 12. It should be noted that in FIG. 7C, the leverage arm 94 is ideally set to make an initial contact with the stop 70 such that the stop is in the first position (i.e., the position of the stop 70 that corresponds to an initial engagement between the leverage arm 94 and the stop 70 and a zero compression of the biasing element 88 via the leverage arm 94). The biasing element 88 may, however, may be loaded to a desired preload compression in FIG. 7C. Next, the drum beater 12 further penetrates the drumhead 202 to creating the desired punch sound vibration in FIG. 7D. It should be noted in FIG. 7D, the leverage arm 94 has advanced the stop 70 to the second position, which corresponds to the desired forward position of the drum beater 12 in the first direction 32 and a desired compression of the biasing element 88 via the leverage arm 94.

Figure 7D:
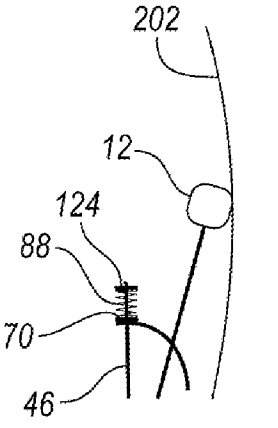
Figure 7E:
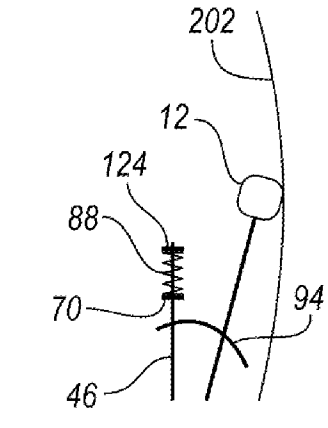
Figure 7F:
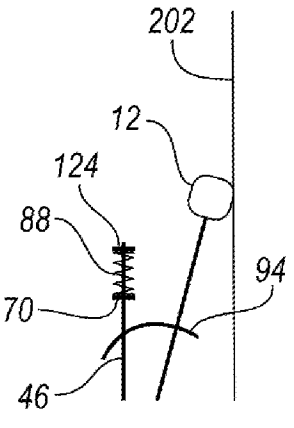
Figure 7G:
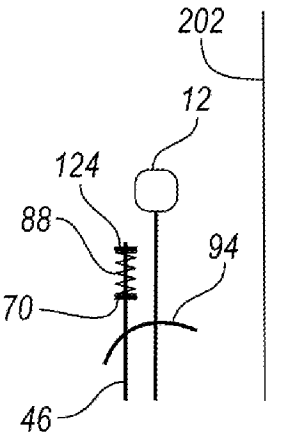
Figure 7H:
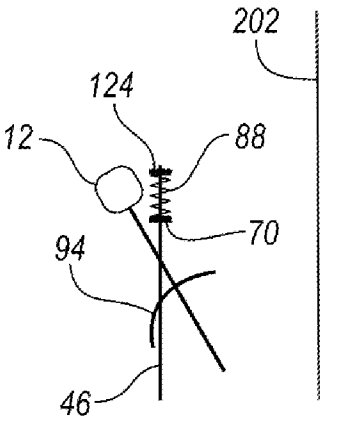

The stress on the drumhead 202 is still too small in FIG. 7D to overcome the inertia force of the drum beater 12. However, the drum beater 12 does not further advance into the drumhead 202, because the compression force on the biasing element 88 is set to overcome the inertia force of the drum beater 12. The drum beater 12 is then retracted in FIGS. 7E through 711 via the return spring 40 (from the position in FIG. 7D) while preserving the fundamental note (i.e., the desired sound) without producing the undesirable overtones since the drumhead 202 was not over stretched. The drum beater returns to the home or retracted position at FIG. 711.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A kick drum pedal assembly comprising:

a base member;

a footboard rotatably secured to the base member;

an upright member secured to and extending upward from the base member;

a drum beater rotatably secured to an opposing end of the upright member relative to the base member, wherein the drum beater is connected to the footboard such that depression of the footboard rotates the drum beater in a first direction about the upright member and such that releasing the footboard rotates the drum beater in a second direction about the upright member that is opposite to the first direction; and a travel limiter configured to limit rotation of the drum beater in the first direction, the travel limiter having, a guide rod having first and second ends, and rotatably secured to the footboard at the first end, a stop secured to the guide rod proximate to the second end, a leverage arm connected to the drum beater such that the leverage arm and drum beater are confined to rotate in unison about the upright member in response to depressing or releasing the footboard, the leverage arm having a follower that is configured to engage and travel along the guide rod in response to rotation of the leverage arm, wherein the leverage arm is configured to engage the stop to limit rotation of the drum beater to a desired forward position in the first direction.

2. The kick drum pedal assembly of claim 1, wherein the travel limiter further comprises a biasing element disposed between the stop and the second end of the guide rod, wherein the biasing element is configured to bias the stop in a direction away from the second end of the guide rod and toward the first end of the guide rod.

3. The kick drum pedal assembly of claim 2, wherein the leverage arm is configured to advance the stop from a first position to a second position in response to depressing the footboard, wherein the first position corresponds to an initial engagement between the leverage arm and the stop and a zero compression of the biasing element via the leverage arm, and wherein the second position corresponds to the desired forward position of the drum beater and a desired compression of the biasing element via the leverage arm.

4. The kick drum pedal assembly of claim 3, wherein the travel limiter further comprises a retainer plate secured to the second end of the guide rod such that the biasing element is disposed between the stop and the retainer plate, and wherein a position of the retainer plate is adjustable relative to the stop such that an adjustment of the retainer plate adjusts a preload force on the biasing element, and wherein an adjustment to the preload force on the biasing element corresponds to an adjustment to the second position of the stop and the desired forward position of the drum beater.

5. The kick drum pedal assembly of claim 1 further comprising a gag linkage secured to the guide rod and a linkage member that connects the drum beater to the footboard, wherein the gag linkage is configured to bias the guide rod into engagement with the follower.

6. The kick drum pedal assembly of claim 5, wherein the linkage member is a chain.

7. The kick drum pedal assembly of claim 1, wherein an axial position of the guide rod relative to the footboard is adjustable at the first end, and wherein an adjustment to the axial position of the guide rod corresponds to an adjustment to the desired forward position of the drum beater.

8. The kick drum pedal assembly of claim 7 further comprising a jam nut configured to engage a threaded portion of the guide rod and the first end of the guide rod to secure the axial position of the guide rod.

9. A kick drum pedal assembly comprising:

a footboard;

a drum beater connected to the footboard, configured to rotate in a first direction in response to depressing the footboard, and configured to rotate in a second direction in response to releasing the footboard;

a guide rail having first and second ends, wherein the first end is secured to the footboard;

a stop secured to the guide rail proximate to the second end; and a leverage arm connected to the drum beater such that the leverage arm and drum beater are confined to rotate in unison, the leverage arm having a follower configured to engage and travel along the guide rail in response to rotation of the leverage arm, wherein the leverage arm is configured to engage the stop to limit rotation of the drum beater to a desired forward position in the first direction.

10. The kick drum pedal assembly of claim 9 further comprising a biasing element disposed between the stop and the second end of the guide rail, wherein the biasing element is configured to bias the stop in a direction away from the second end of the guide rail and toward the first end of the guide rail.

11. The kick drum pedal assembly of claim 10, wherein the leverage arm is configured to advance the stop from a first position to a second position in response to depressing the footboard, wherein the first position corresponds to an initial engagement between the leverage arm and the stop and a zero compression of the biasing element via the leverage arm, and wherein the second position corresponds to the desired forward position of the drum beater and a desired compression of the biasing element via the leverage arm.

12. The kick drum pedal assembly of claim 11 further comprising a retainer plate secured to the second end of the guide rail such that the biasing element is disposed between the stop and the retainer plate, and wherein a position of the retainer plate is adjustable relative to the stop such that an adjustment of the retainer plate adjusts a preload force on the biasing element, and wherein an adjustment to the preload force on the biasing element corresponds to an adjustment to the second position of the stop and the desired forward position of the drum beater.

13. The kick drum pedal assembly of claim 9 further comprising a gag linkage secured the guide rail and a linkage member that connects the drum beater to the footboard, wherein the gag linkage is configured to bias the guide rail into engagement with the follower.

14. The kick drum pedal assembly of claim 9, wherein an axial position of the guide rail relative to the footboard is adjustable at the first end, and wherein an adjustment to the axial position of the guide rail corresponds to an adjustment to the desired forward position of the drum beater.

15. A kick drum pedal assembly comprising:

a footboard;

a beater connected to the footboard and configured to rotate in response to depressing the footboard; and a travel limiter configured to limit rotation of the beater, the travel limiter having an arm connected to the beater and a stop connected to the footboard, wherein the arm and beater are confined to rotate in unison, and wherein the arm is configured to engage the stop to limit rotation of the beater to a desired forward position in response depressing the footboard, wherein the travel limiter further comprises a guide rail having first and second ends, wherein the first end is secured to the footboard, wherein the stop is secured to the guide rail proximate to the second end, and wherein the arm is configured to engage and travel along the guide rail in response to rotation of the arm.

16. The kick drum pedal assembly of claim 15, wherein the travel limiter further comprises a biasing element disposed between the stop and the second end of the guide rail, and wherein the biasing element is configured to bias the stop in a direction away from the second end of the guide rail and toward the first end of the guide rail.

17. The kick drum pedal assembly of claim 16, wherein the arm is configured to advance the stop from a first position to a second position in response to depressing the footboard, wherein the first position corresponds to an initial engagement between the arm and the stop and a zero compression of the biasing element via the arm, and wherein the second position corresponds to the desired forward position of the beater and a desired compression of the biasing element via the arm.

18. The kick drum pedal assembly of claim 17, wherein the travel limiter further comprises a retainer plate secured to the second end of the guide rail such that the biasing element is disposed between the stop and the retainer plate, wherein a position of the retainer plate is adjustable relative to the stop such that an adjustment of the retainer plate adjusts a preload force on the biasing element, and wherein an adjustment to the preload force on the biasing element corresponds to an adjustment to the second position of the stop and the desired forward position of the beater.

19. The kick drum pedal assembly of claim 15, wherein an axial position of the guide rail relative to the footboard is adjustable at the first end, and wherein an adjustment to the axial position of the guide rail corresponds to an adjustment to the desired forward position of the beater.

* * * * *